US007199295B2

(12) United States Patent
Oskorep

(10) Patent No.: US 7,199,295 B2
(45) Date of Patent: Apr. 3, 2007

(54) GUITAR PICK HOLDER MADE OF A FLEXIBLE SYNTHETIC LAYER OF MATERIAL WHICH IS SUFFICIENTLY PLASTICIZED SUCH THAT GUITAR PICKS CLING TO ITS OUTER SURFACE WHEN DEPRESSED THEREAGAINST

(76) Inventor: John Jeffrey Oskorep, 416 W. Briar Pl., Unit #3, Chicago, IL (US) 60657

( * ) Notice: Subject to any disclaimer, the term of this patent is extended or adjusted under 35 U.S.C. 154(b) by 0 days.

(21) Appl. No.: 10/892,955

(22) Filed: Jul. 16, 2004

(65) Prior Publication Data

US 2005/0011336 A1 Jan. 20, 2005

Related U.S. Application Data

(60) Provisional application No. 60/487,419, filed on Jul. 16, 2003.

(51) Int. Cl.
*G10D 3/16* (2006.01)

(52) U.S. Cl. ..... 84/322

(58) Field of Classification Search ..... 84/320–322
See application file for complete search history.

(56) References Cited

U.S. PATENT DOCUMENTS

| | | | | |
|---|---|---|---|---|
| 3,789,720 | A * | 2/1974 | McIntyre | 84/322 |
| 4,135,431 | A * | 1/1979 | Ferguson | 84/329 |
| 4,890,531 | A * | 1/1990 | Tischer | 84/329 |
| 5,488,892 | A * | 2/1996 | Jepsen | 84/322 |
| 5,859,377 | A * | 1/1999 | Mackey et al. | 84/322 |
| 5,905,217 | A * | 5/1999 | Byers | 84/322 |
| 5,920,023 | A | 7/1999 | Ravagni et al. | |
| 6,040,512 | A * | 3/2000 | Polley | 84/322 |
| 6,903,256 | B2 * | 6/2005 | Pittman et al. | 84/322 |
| 2004/0074368 | A1 | 4/2004 | Oskorep | |
| 2004/0074369 | A1 | 4/2004 | Oskorep | |

OTHER PUBLICATIONS

"Sticky Pad", American Covers,Inc., http://www.handstands.com/retail/stickypads.html, pp. 1-2.
"E.Z. Mount-Stamp N' Stor" Sunday International,http://www.sundayint.com/2howto/mountinginstructions.asp.
"Kling-On" Kling-On Guitar Products, Product insert, www.kling-on.com.
"Sticky Pad", American Covers,Inc., Product insert.
"E.Z. Mount-Stamp N' Stor" Sunday International, Product insert.

* cited by examiner

*Primary Examiner*—Kimberly Lockett
(74) *Attorney, Agent, or Firm*—John J. Oskorep, Esq.

(57) ABSTRACT

In one illustrative example disclosed, a guitar pick holder is made of a thin, flat, and visually-appealing flexible synthetic layer of material which adheres to a front outside surface of a guitar. The flexible synthetic layer of material is sufficiently plasticized such that its front outer surface provides a clinging hold to guitar picks made of, for example, celluloid or nylon. The guitar pick is held against the front surface of the flexible synthetic layer of material and is thereby carried with the guitar, even when it is subject to relatively strong forces of accelerative motion (i.e. when the guitar is physically handled or shaken).

28 Claims, 2 Drawing Sheets

GUITAR PICK HOLDER MADE OF A FLEXIBLE SYNTHETIC LAYER OF MATERIAL WHICH IS SUFFICIENTLY PLASTICIZED SUCH THAT GUITAR PICKS CLING TO ITS OUTER SURFACE WHEN DEPRESSED THEREAGAINST

CROSS-REFERENCE TO RELATED APPLICATION

This application claims priority to a U.S. provisional patent application entitled "Guitar Pick Holder Made Of A Flexible Synthetic Layer Of Material Which Is Sufficiently Plasticized Such That Guitar Picks Cling To Its Outer Surface When Depressed Thereagainst" having U.S. Ser. No. 60/487,419 and a filing date of Jul. 16, 2003, hereby incorporated by reference herein.

BACKGROUND

1. Field of the Invention

The present invention relates generally to the field of guitars and guitar picks, and more particularly to a guitar pick holder made of a flexible synthetic layer of material which is sufficiently plasticized such that guitar picks cling to its outer surface when depressed thereagainst.

2. Description of the Problem

A guitar is typically played with a "guitar pick", which is used to strike or pluck strings of the guitar. Many guitar players carry a number of guitar picks with them as they are relatively small, easily lost, and inexpensive. However, it is often inconvenient to store or retrieve guitar picks. Guitar picks are typically carried in pants pockets and/or within guitar cases and need to be retrieved when the guitar is played. When a guitar is taken out of its guitar case, for example, a guitar pick must be retrieved from some location. Conversely, when a guitar is placed back in its case, the guitar pick must be stored somewhere. When a guitar player is playing and accidentally drops or intentionally tosses away the guitar pick, it is desirable to be able to quickly retrieve another one.

The majority of guitar picks are made from a plastic or synthetic material and provide a desired flexibility and durability. Guitar players have grown accustomed to the "look and feel" of such plastic guitar picks. Although some guitar picks are made entirely of a metal or perhaps metal alloy, such guitar picks are not as popular as plastic guitar picks. In addition, the appearance of guitars and guitar picks are fairly important to guitar players, and therefore it is preferable that any method used to hold or carry guitar picks does not detract from how these items look. Furthermore, guitar picks should be inexpensively made so that they may become commercially available and ubiquitous to a large number of consumers. Promotional and marketing techniques are also important in the industry.

Copending patent applications of the present inventor describe a magnetic solution for holding guitar picks, where a flexible magnet is adhered to a guitar and the guitar picks include a metal material. A flexible magnet "guitar pick holder" which carries such magnetically attractable guitar picks is the primary subject of copending patent applications entitled "Guitar Pick Holder Made Of A Flexible Magnetic Body" having U.S. Ser. No. 10/348,056 and a filing date of Jan. 21, 2003, and "Methods Of Making A Guitar Pick Holder Comprising A Flexible Magnetic Material" having U.S. Ser. No. 10/366,263 and a filing date of Feb. 13, 2003. It is described in the above-mentioned patent applications that the flexible magnet may include a rear static cling vinyl adhering surface for adhering to a glossy surface of a guitar. In copending provisional application entitled "Guitar Pick Holder Made Of A Flexible Magnetic Body Having A Dimensionally-Stable Static Cling Vinyl Adhering Layer", a laminate of static cling vinyl and polyester is used for the same purpose.

In another copending patent application entitled "Guitar Pick Comprising A Blend Of Plastic And Magnetically Receptive Material" having U.S. Ser. No. 10/365,985 and a filing date of Feb. 13, 2003, a guitar pick is formed from a blend of plastic and metal material to have the look-and-feel of a plastic guitar pick but still be magnetically attractable. In yet another copending patent application entitled "Guitar Pick Stickers Which Impart A Magnetic Attraction To Synthetic Guitar Picks" having U.S. Ser. No. 10/408,270 and a filing date of Apr. $7^{th}$, 2003, what is described is a guitar pick sticker which is used to adhere to a surface of a guitar pick to make it magnetically attractable so that it can be used with a magnetic guitar pick holder. Finally, in another copending patent application entitled "Guitar Pick Having A Static Cling Vinyl Adhering Surface" having U.S. Provisional Ser. No. 60/468,461 and a filing date of May 8, 2003, what is described is a guitar pick which has a static cling vinyl adhering surface which provides a "cling" to a glossy surface of a guitar without the need for a separate guitar pick holder.

Even though such guitar pick holding solutions are available, in some cases it may not be preferred to use special guitar picks or to modify off-the-shelf guitar picks. Accordingly, what is needed is a guitar pick holding solution which accommodates these needs.

SUMMARY

In one illustrative example, a guitar pick holder is made of a thin, flat, and visually-appealing flexible synthetic layer of material which adheres to a front outside surface of a guitar. The flexible synthetic layer of material is sufficiently plasticized such that its front outer surface provides a "clinging" hold to guitar picks made of, for example, celluloid or nylon. The guitar pick is held against the front surface of the flexible synthetic layer of material and is thereby carried with the guitar, even when it is subject to relatively strong forces of accelerative motion (i.e. when the guitar is physically handled or shaken).

DETAILED DESCRIPTION OF THE PREFERRED EMBODIMENTS

Figure 1:
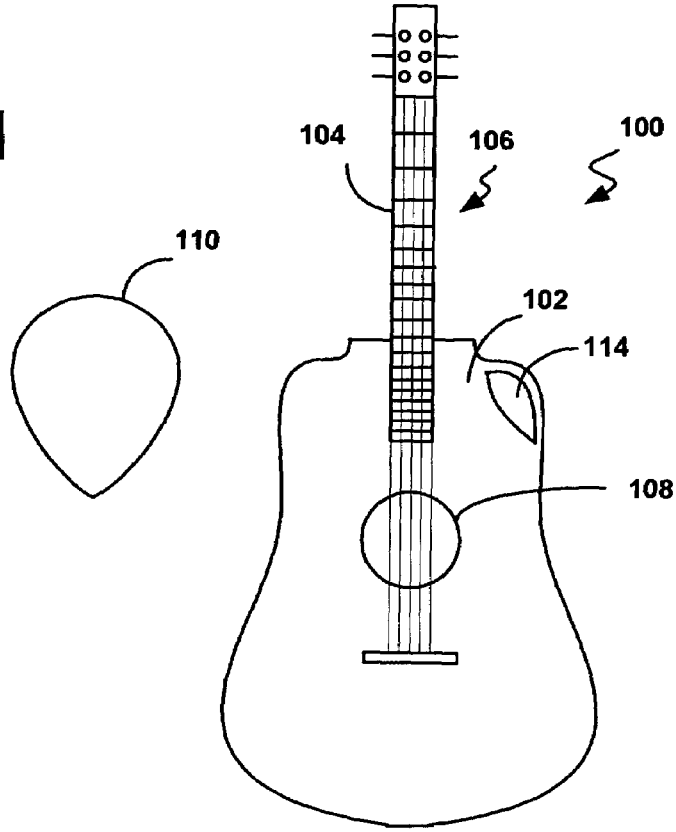
FIG. 1 is an illustration of a guitar with a guitar pick holding system which includes a flexible body and a guitar pick.

FIG. 1 is an illustration of a guitar 100 and a guitar pick 110 for use in connection with a guitar pick holder of the present application. Guitar 100 is a conventional acoustic guitar having a guitar body 102, a neck 104, a sound hole 108, and a plurality of guitar strings 106 (six in total). Guitar 100 may alternatively be an electrical guitar, such as a 6-string electric guitar or a bass guitar. Guitar body 102 is typically made of wood, but could be made of other suitable materials and include a lamination. Typically, guitar body 102 has a transparent or translucent gloss finish. The plurality of guitar strings 106 are typically made of steel, some of which may be wound with nickel.

A guitar pick holder of the present application is made of a flexible synthetic layer of material 114 (hereinafter "flexible body"). Flexible body 114 has a rear adhering surface for use in adhering to a surface of guitar body 102. A front outer surface of flexible body 114 is for use in holding and carrying guitar pick 110. In particular, flexible body 114 is sufficiently plasticized such that guitar pick 110 (and others) clings to its front outer surface when depressed thereagainst. The flexible synthetic layer of material may be any suitable layer of synthetic material which is flexible and capable of being sufficiently plasticized for this easy application.

Such materials may include polyvinyl chloride (PVC) or static cling vinyl, for example. Static cling vinyl is typically used for decorative purposes, such as for seasonal window graphics, signs, decals, or protective masking applications. Static cling vinyl is a formulation of PVC to which a large amount of plasticizer (a liquid) has been added. This highly plasticized formulation is very pliable. The vinyl is typically calendered to give it a smooth finish. When such film is applied to a smooth glossy surface in conventional usage, it adheres firmly without the need for an adhesive. Because there is no adhesive, application is very easy and it can be removed and reapplied nearly indefinitely. In the present invention, the guitar is provided with the plasticized material so that conventional guitar picks may be clung to its surface. Such static cling vinyl materials may be obtained from any suitable manufacturer or company, such as from Beacon Graphics having offices at 189 Meister Avenue, Somerville, N.J., 08876, USA. Other plasticized materials may exist or be devised and the term "static cling vinyl" is intended to include such other alternative formulations which achieve the same results.

Preferably, flexible body 114 is made of a soft plasticized foam material. This allows an outer surface of guitar pick 110 to be more satisfactorily depressed against the outer surface of flexible body 114 for sufficient clinging. The foam material could be, as examples, PVC foam, polyurethane, polystyrene, or other suitable synthetic material. The plasticizer used in any of these materials may be any suitable plasticizer.

Guitar pick 110, which is shown in FIG. 1 in enlarged view relative to guitar 100, is generally made of a resilient synthetic material, such as a plastic. In particular, guitar pick 110 is suitably formed from a material which provides a suitable "glossy"-type surface which clings to the outer surface of flexible body 114. The material of guitar pick 110 may be, for example, celluloid or nylon. Preferably, guitar pick 110 is a conventional "off-the-shelf" synthetic guitar pick made from these materials.

It is noted that some common materials utilized for guitar picks, such as guitar picks made of acetal or delrin, will not naturally provide this suitable surface for clinging to the outer surface of flexible body 114. Any suitable material for guitar pick 110 may be utilized, however, as long as a sufficient clinging surface is provided of guitar pick 110, whether the guitar pick body itself, by a glossy coating provided on the guitar pick surface, or by a glossy laminate (e.g. vinyl or polyester laminate) on the guitar pick surface.

Figure 2:
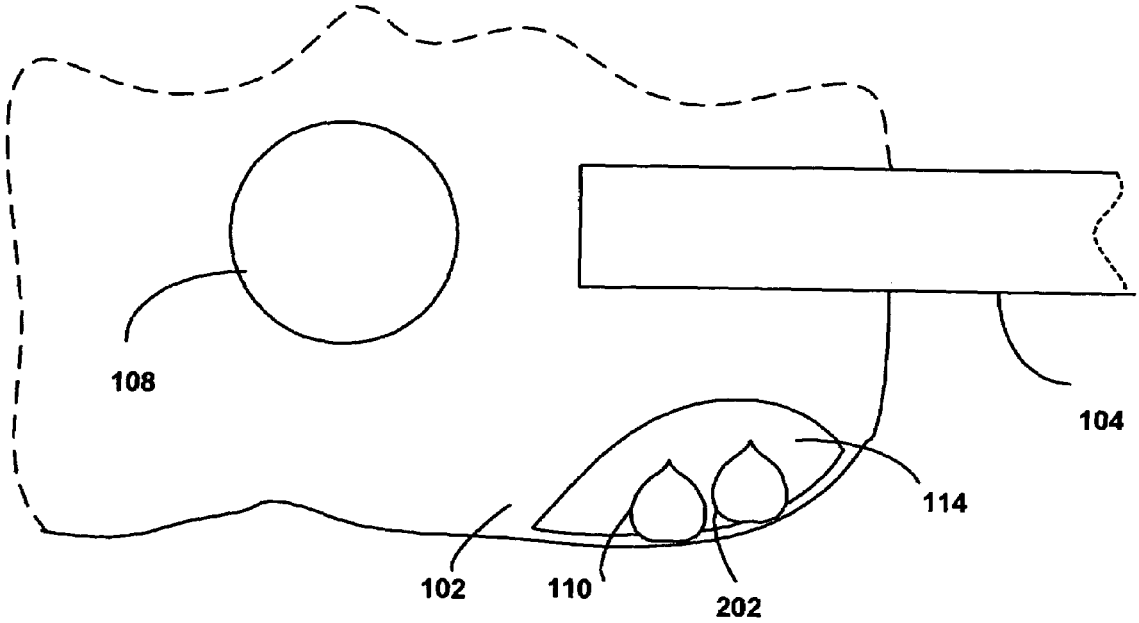
FIG. 2 is a close-up illustration of the guitar pick holding system of FIG. 1 in use with the guitar.

In FIG. 2, a close-up illustration of the guitar pick holding system of FIG. 1 in use with guitar 100 is shown. As shown, guitar pick 110 is attached to and carried over the outside front surface of guitar body 102 due to "plasticizer cling" to flexible body 114, which is itself adhered to the guitar's front surface. This remains true even when the guitar is held in the position shown (i.e. guitar pick 110 being subject to downward gravitational forces) and even when it is subject to relatively strong forces of accelerative motion (i.e. guitar body 102 is physically handled or shaken). Advantageously, the plasticizer adhering forces provided by flexible body 114 are sufficiently large enough to carry and hold guitar pick 110 (a very lightweight object) with guitar body 102. Also advantageously, the plasticizer "cling" provided on the outer surface of flexible body 114 is sufficient such that guitar pick 110 (and other guitar picks) tends not to be jarred off of the outer surface of flexible body 114 when accidental physical contact is made with them (through body contact, such as physical jarring from the arm or body). In this respect, the guitar pick holder system of the present invention is better than guitar pick holders of the magnetic type.

Preferably, flexible body 114 is positioned along a front bottom edge (right-handed perspective) above sound hole 108 of guitar 100, as shown in FIGS. 1 and 2. However, any suitable areas of attachment may be utilized. FIG. 2 also shows that additional guitar picks 202 may be included in the system. Preferably, flexible body 114 is thin (e.g. less than 5 mm or 0.2 inches in thickness) and has a length of between about 7.6–12.7 cm (between about 3–5 inches) to simultaneously accommodate a number of different guitar picks. Preferably, flexible body 114 has sufficient flexibility to maintain conformity to curved surfaces of guitar body 102 (e.g. curved side edges) if desired or needed.

Figure 3:
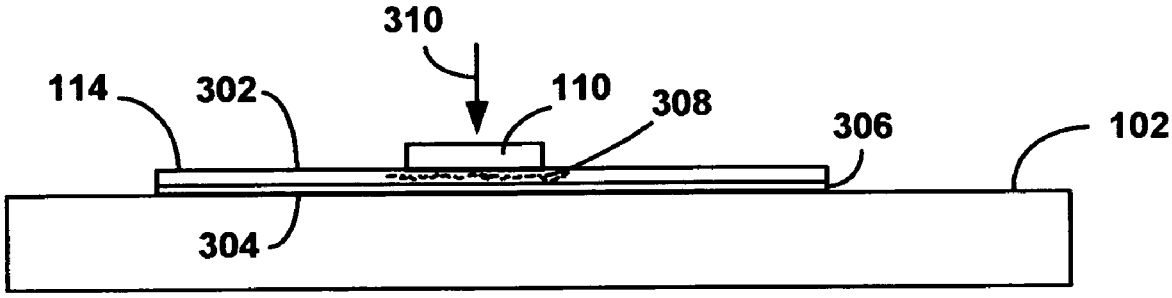
FIG. 3 is a cross-sectional view of the guitar pick holding system of FIGS. 1–2.

FIG. 3 is a cross-sectional view of the guitar pick holding system on guitar body 102 of FIG. 2. Thicknesses and relative thicknesses of the materials are exaggerated in FIG. 3 for illustrative purposes only. In FIG. 3, it is shown that flexible body 114 has an exposed outer front surface 302 for holding guitar pick 110 and a rear surface 304 which includes an adhering layer 306. Plasticizers 308 are provided in flexible body 114 sufficient such that guitar pick 110 clings to front surface 302 when depressed thereagainst in a direction 310 towards front surface 302 as indicated.

The rear adhering surface of flexible body 114 is preferably flat so that it conforms and adheres well to a variety of non-planar surfaces (e.g. curved side edges) as well as planar surfaces of a guitar body 102. Adhering layer 306 on this rear surface 304 provides for a semi-permanent attachment of flexible body 114 to guitar body 102. Preferably, adhering layer 306 is a static cling vinyl layer. This static cling vinyl layer may be adhesively attached to the rear surface of flexible body 114. If a separate static cling vinyl layer is used as rear adhering layer 306, a dimensionally-stable layer is preferably provided between it and the flexible synthetic layer of material. The dimensionally-stable layer may be, for example, polyester, which also provides a barrier to plasticizer migration between the static cling vinyl and the flexible synthetic layer of material (e.g. to protect any printed text or design over the static cling vinyl). In an alternative embodiment, adhering layer 306 is the same material as the flexible synthetic plasticized layer of material which provides the "cling" to the glossy surface of the guitar. In this case, only a single layer of material is advantageously used as the flexible synthetic layer of material.

Some guitar surfaces have a nitrocellulose lacquer, which may be marred by plasticized PVC. Thus, in an alternate embodiment, adhering layer 306 of flexible body 114 is an adhesive layer. The adhesive may be a relatively "heavy" adhesive or light temporary adhesive, and preferably one which leaves no adhesive residue (e.g. an adhesive which provides for reapplication and repositioning, such as a Post-It™ notes type adhesive by Spencer Silver) and provides an impermanent bond. Most manufacturers typically provide material sheets with an optional adhesive backing. A low-tack micro-voided adhesive, called "Supercling", for example, is available from Plastiprint, Inc. of 445 Union Boulevard, Suite 209, Lakewood, Colo., 80228 USA. In yet another alternate embodiment, adhering layer 306 includes metal or magnetic material, which provides flexible body 114 with a magnetic attraction to a guitar body which has a metal or magnetic material surface.

Flexible body 114 may also be provided with a removable backing sheet over adhering layer 306 (not shown) which is removed prior to attachment of flexible body 114 to guitar body 102. This removable backing sheet is provided especially where adhering layer 306 includes a static cling vinyl or adhesive surface.

It is preferred that flexible body 114 be relatively thin (e.g. less than 5 mm or 0.2 inches in thickness). When flexible body 114 is kept thin, its front outer surface remains relatively flush with the surface of guitar body 102 so that guitar picks may be more easily handled. For example, a thin flexible body 114 has a tendency to stay clear of obstructions which may jar guitar pick 110 and/or flexible body 114 off of guitar body 102. In addition, a thin constitution also helps provide flexible body 114 with the appearance of a decorative "decal" for decorating the front surface of guitar 100. Although flexible body 114 may be formed with any suitable length and width, it is preferred that flexible body 114 have a length of between about 6:35 centimeters (about 2.5 inches) to 11.43 centimeters (about 4.5 inches), and a width of between about 1 centimeter (about 0.4 inches) to 2.5 centimeters (about 1 inch). For example, flexible body 114 may have a length of about 8.9 centimeters (about 3.5 inches) and a width of about 1.5 centimeters (about 0.6 inches), suited to fit to most electric guitars along their narrow bottom "handle" near where a guitar player's fingers generally rest. With this length and width, flexible body 114 has a surface area sufficient to hold at least three guitar picks. Note that the width of flexible body 114 need not (and preferably does not) cover the entire surface area of guitar pick 110; the surface area of flexible body 114 may cover only between about 50%–80% of each guitar pick 110. For example, flexible body 114 may cover about 75%, 66%, or 50% of the surface area each guitar pick 110.

Flexible body 114 may also take on a variety of visually appealing shapes, styles, and colors. In this case, flexible body 114 may be viewed as a decorative design for a front surface of a guitar (which may include a printed decorative coloring or design). Different predetermined shapes, such as a rectangle, a star, a circle, a cross, and an arrow. Other shapes may be provided, such as a diamond, one or more footprints, a lightning bolt, an S-shape, a Z-shape, an arc, an ellipse, etc. The shape may be in the form of a pickguard of a guitar, and be used for such purpose. Preferably, flexible body is either white or black. Other suitable colors may be used as well, such as the color red, yellow, blue, green, etc. Each flexible body, as described above, has an adhering layer on a rear surface (with a removable backing sheet which covers the adhering layer) and a front surface which provides a plasticizer "cling" to guitar picks (and preferably revealing a coloring/design and/or glossy layer). Thus, if the flexible body is very thin and has a decorative shape, it appears to be a cosmetic "decal" or design on the front surface of a guitar. Flexible body 114 may be attached anywhere on the guitar (or other objects such as guitar cases, guitar straps, etc.) for decorative design as well as for holding guitar picks.

Final Comments. Thus, a guitar pick holder of the present invention is made of a thin, flat, and visually-appealing flexible synthetic layer of material which adheres to a front outside surface of a guitar. The flexible synthetic layer of material is sufficiently plasticized such that its front outer surface provides a clinging hold to guitar picks made of, for example, celluloid or nylon. The guitar pick is held against the front surface of the flexible synthetic layer of material and is thereby carried with the guitar, even when it is subject to relatively strong forces of accelerative motion (i.e. when the guitar is physically handled or shaken).

It is to be understood that the above is merely a description of preferred embodiments of the invention and that various changes, alterations, and variations may be made without departing from the true spirit and scope of the invention as set for in the appended claims. The guitar utilized may be an acoustic or an electrical guitar, which may be a 6-string electric guitar or a bass guitar. Few if any of the terms or phrases in the specification and claims have been given any special particular meaning different from their plain language meaning, and therefore the specification is not to be used to define such terms in an unduly narrow sense.

What is claimed is:

1. A guitar pick holder, comprising:

a flexible synthetic layer of material having a front outer plasticized surface;

a rear adhering surface on the flexible synthetic layer of material opposite the front outer plasticized surface, the rear adhering surface for use in providing a semi-permanent attachment of the flexible synthetic layer of material including its front outer plasticized surface to a surface of a guitar;

the flexible synthetic layer of material being sufficiently plasticized such that one or more guitar picks cling to be held and carried against the front outer plasticized surface by plasticizer adhesion to the front outer plasticized surface when depressed thereagainst in a direction perpendicular to the front outer plasticized surface, and such that the one or more guitar picks are removable from the front outer plasticized surface while the flexible synthetic layer of material including its front outer plasticized surface remains attached to the surface of the guitar; and the front outer plasticized surface of the flexible synthetic layer of material being void of adhesive for the one or more guitar picks to be held and carried against the front outer plasticized surface for the plasticizer adhesion.

2. The guitar pick holder of claim 1, wherein the flexible synthetic layer of material comprises a resilient foam.

3. The guitar pick holder of claim 1, wherein the flexible synthetic layer of material comprises polyvinyl chloride (PVC).

4. The guitar pick holder of claim 1, wherein the flexible synthetic layer of material comprises polyvinyl chloride (PVC) foam.

5. The guitar pick holder of claim 1, wherein the flexible synthetic layer of material including its front outer plasticized surface consists of only a single layer of material.

6. The guitar pick holder of claim 1, wherein the rear adhering surface is for use in adhering the flexible synthetic layer of material to a front surface of the guitar for a guitar player to regularly hold and remove the one or more guitar picks during use of the guitar.

7. The guitar pick holder of claim 1, wherein the one or more guitar picks are made of nylon integrally formed with an outer surface to cling to be held and carried against the front outer plasticized surface by the plasticizer adhesion without any intervening materials between the outer surface and the front outer plasticized surface.

8. The guitar pick holder of claim 1, wherein the rear adhering surface comprises static cling vinyl.

9. The guitar pick holder of claim 1, wherein the one or more guitar picks are made of celluloid integrally formed with an outer surface to cling to be held and carried against the front outer plasticized surface by the plasticizer adhesion without any intervening materials between the outer surface and the front outer plasticized surface.

10. The guitar pick holder of claim 1, wherein the rear adhering surface comprises a low-tack adhesive.

11. The guitar pick holder of claim 1, wherein the rear adhering surface comprises plasticized polyvinyl chloride (PVC).

12. The guitar pick holder of claim 1, wherein the one or more guitar picks comprise a celluloid material.

13. The guitar pick holder of claim 1, wherein the one or more guitar picks comprise a nylon material.

14. The guitar pick holder of claim 1, wherein the one or more guitar picks are integrally formed with an outer surface which is sufficiently smooth to cling to the front outer plasticized surface of the flexible layer of synthetic material by the plasticizer adhesion without any intervening materials between the outer surface and the front outer plasticized surface.

15. A guitar, comprising:

a guitar body;

a flexible synthetic layer of material carried on the guitar body and exposing a front outer plasticized surface;

the flexible synthetic layer of material being sufficiently plasticized such that one or more guitar picks cling to be held and carried against the front outer plasticized surface by plasticizer adhesion to the front outer plasticized surface when depressed thereagainst in a direction perpendicular to the front outer plasticized surface, and such that the one or more guitar picks are removable from the front outer plasticized surface while the flexible synthetic layer of material including its front outer plasticized surface remains carried on the guitar body; and the front outer plasticized surface of the flexible synthetic layer of material being void of adhesive for the one or more guitar picks to be held and carried against the front outer plasticized surface for the plasticizer adhesion.

16. The guitar of claim 15, wherein the flexible synthetic layer of material comprises foam.

17. The guitar of claim 15, wherein the flexible synthetic layer of material comprises polyvinyl chloride (PVC).

18. The guitar of claim 15, wherein the flexible synthetic layer of material comprises polyvinyl chloride (PVC) foam.

19. The guitar of claim 15, wherein the flexible synthetic layer of material comprises one of polyurethane and polystyrene.

20. The guitar of claim 15, wherein the flexible synthetic layer of material including its front outer plasticized surface consists of only a single layer of material.

21. The guitar of claim 15, wherein the one or more guitar picks comprise a celluloid material.

22. The guitar of claim 15, wherein the flexible synthetic layer of material is carried on a front surface of the guitar body for a guitar player to regularly hold and remove the one or more guitar picks during use of the guitar.

23. The guitar of claim 15, wherein the one or more guitar picks are integrally formed with an outer surface which is sufficiently smooth to cling to the front outer plasticized surface by the plasticizer adhesion without any intervening materials between the outer surface and the front outer plasticized surface.

24. A guitar pick holder, comprising:

a flexible body comprising a foam material having a front outer plasticized surface and a rear adhering surface opposite the front outer plasticized surface;

the rear adhering surface for use in providing the flexible body including its front outer plasticized surface with a semi-permanent attachment to a surface of a guitar;

the front outer plasticized surface of the foam material being sufficiently plasticized such that one or more guitar picks cling to be held and carried against the front outer plasticized surface by plasticizer adhesion to the front outer plasticized surface when depressed thereagainst in a direction towards the front Outer plasticized surface, and such that the one or more guitar picks are removable from the front outer plasticized surface while the flexible body including its front outer plasticized surface remains attached to the surface of the guitar; and the front outer plasticized surface of the flexible body being void of adhesive for the one or more guitar picks to be held and carried against the front outer plasticized surface for the plasticizer adhesion.

25. The guitar pick holder of claim 24, wherein the one or more guitar picks are integrally formed with an outer surface which is sufficiently smooth to cling to the front outer plasticized surface of the flexible body by the plasticizer adhesion without any intervening materials between the outer surface and the front outer plasticized surface.

26. The guitar pick holder of claim 24, wherein the foam material comprises polyvinyl chloride (PVC).

27. The guitar pick holder of claim 24, wherein the foam material comprises a resilient foam material which allows the one or more guitar picks to be depressed against the front outer surface for sufficient cling for being carried and held against the front outer surface.

28. The guitar pick holder of claim 24, wherein the rear adhering surface comprises one of an adhesive surface and a plasticized surface for clinging to the surface of the guitar.

* * * * *